United States Patent [19]

Poma

[11] 4,012,915

[45] Mar. 22, 1977

[54] DRIVING TIPS FOR FORMING CAST-IN-PLACE CASELESS CONCRETE PILES

[75] Inventor: Luis Poma, San Salvador, El Salvador

[73] Assignee: Interpile USA, Inc., New Orleans, La.

[22] Filed: July 18, 1975

[21] Appl. No.: 597,090

[52] U.S. Cl. ..... 61/53; 61/53.52

[51] Int. Cl.[2] ..... E02D 5/72

[58] Field of Search ..... 61/53, 53.5, 53.52, 61/53.64, 53.66

[56] References Cited

UNITED STATES PATENTS

| | | | |
|---|---|---|---|
| 262,569 | 8/1882 | Case | 61/53 |
| 903,441 | 11/1908 | Brace | 61/53.66 |
| 1,275,470 | 8/1918 | Pruyn | 61/53.66 X |
| 3,034,304 | 5/1962 | Upson | 61/53.66 X |
| 3,540,225 | 11/1970 | Müller | 61/53.52 |
| 3,638,433 | 2/1972 | Sherard | 61/53.5 X |

*Primary Examiner*—Paul R. Gilliam
*Assistant Examiner*—David H. Corbin
*Attorney, Agent, or Firm*—Mason, Fenwick & Lawrence

[57] ABSTRACT

Driving tips for forming cast-in-place caseless piles by driving a vertically elongated mandrel having one of the driving tips releasably fitted on the bottom of the mandrel, to thereby produce the pile-forming hole in the earth to be filled with flowable concrete or other fill material. The driving tips have a lower leading end plate of circular cross-section of larger diameter than the mandrel, and include straight parallel rod members rising perpendicularly from the end plate paralleling the center axis of the end plate and located at circumferentially spaced locations along a circular path having a diameter slightly smaller than the inner diameter of the mandrel and concentric with said center axis, rods or cylindrical members to interfit in the hollow interior bore in the mandrel and thereby center the tip relative thereto.

7 Claims, 12 Drawing Figures

Fig-4-A

DRIVING TIPS FOR FORMING CAST-IN-PLACE CASELESS CONCRETE PILES

BACKGROUND AND OBJECTS OF THE INVENTION

The present invention relates in general to driving tips for use in connection with pile driving rigs for forming cast-in-place caseless concrete piles. More particularly, the present invention relates to the construction and configuration of various tip members or foot members which are to be releasably assembled onto a hollow driving mandrel and driven into the ground to form a pile forming cavity or hole which is supplied with flowable concrete or fill material either concurrently with the driving operation or otherwise to form the cast-in-place caseless pile, the driving mandrel being withdrawn for reuse while the driving tip or foot member remains in the ground as the lower extremity of the pile.

One known procedure for forming caseless concrete piles in which the driving tips or foot members of the present invention may be advantageously used involves advancing into the soil a pile tip or driving member, achieved, for example, by the use of a hollow driving mandrel and conventional pile driving rig, and continuously providing an adequate supply of fluid or flowable concrete or similar fill material about and/or within the mandrel so that the concrete can flow or be directed into the ground cavity being formed by the driving tip and mandrel. In one preferred embodiment, the mandrel is an elongated tubular hollow driving member of cylindrical configuration with a large central bore extending from end to end and having a plurality of holes or slots distributed about the tube wall of the mandrel to permit significant flow of the concrete or fill material between the space within the hollow bore of the mandrel and the space immediately outwardly of the exterior mandrel surface. Usually, some type of receptacle or hopper device, usually called a fill hopper, having downwardly inclined converging wall portion converging to a central lower discharge opening is placed on the ground at the pile site and the mandrel, releasably coupled with the driving tip or foot member, extends downwardly through the upwardly opening receptacle portion of the hopper and the lower discharge opening. As the driving tip or foot member is driven into the ground by the energy supplied to the mandrel, thereby producing a pile forming cavity or hole in the ground immediately below and communicating with the lower discharge opening of the hopper, the fill material flows by gravity into the annular space immediately surrounding the mandrel between the mandrel surface and the perimeter of the discharge opening and flows also through the holes or slots in the tube wall of the mandrel into the central bore of the mandrel and downwardly to maintain the space within the pile forming cavity not occupied by the mandrel and boot completely filled with the flowable concrete or fill material. When the driving tip has been driven to the desired depth to produce a pile forming hole or cavity of appropriate axial height, the mandrel is then withdrawn upwardly permitting flowable concrete to fill the space previously occupied by the tube walls of the mandrel and such additional concrete flows from the hopper into the upper portions of the pile cavity to properly top off the concrete pile. The mandrel and fill hopper devices are then moved to the next pile site to repeat the procedure and form another cast-in-place concrete pile.

In practicing the method of forming caseless cast-in-place concrete piles by driving a tip or driving foot member releasably coupled on the bottom of a driving mandrel extending vertically downwardly through a fill hopper, and concurrently supplying concrete in flowable condition into the cavity or pile-forming fold as it is being formed, a number of problems are encountered in regard to the configuration, design, and structural nature of the driving tip member. When the driving tip member is in the general configuration of a boot assembled onto the lower end of the mandrel, wherein the boot has a bottom plate of generally circular configuration and a cylindrical sleeve extending upwardly from the bottom or leading end plate, difficulties are encountered in centering the boot on the mandrel and maintaining it in proper alignment. Also, when working in difficult conditions, particularly where large amounts of water are present, difficulty has been encountered in centering the driving tip over the exact pile location. Furthermore, in forming piles with the herein described method, it is sometimes found desirable to permit fill material to flow from the inside of the mandrel to the outside of the pile cavity externally of the outer surface of the driving boot or tip. For example, it may be desirable to continuously supply fill material from the region within and surrounded by the drive boot to the region immediately outwardly surrounding the outer surface of the sleeve or cylindrical portion of the boot to line the walls of the cavity being formed in the ground between the boot and the cavity wall with the fill material.

Another object of the present invention, therefore, is the provision of a driving boot construction for use in the hereinabove described pile-forming method, wherein the boot is furnished with surface portions which engage sides of the mandrel at a plurality of circumferentially spaced locations extending over a sufficient axial extent of the mandrel to maintain the boot substantially centered in coaxial relation on the mandril.

Yet another object of the present invention is the provision of a driving boot or tip construction for use in practicing the above-described pile-forming method, wherein a downwardly projecting elongated spike is formed on the underside of the leading end plate portion of the boot or tip to enter the soil and locate the plate portion of the boot at the precise pile location preliminary to and during the initial stages of driving of the boot to form the pile-forming hole.

Yet another object of the present invention is the provision of a driving boot construction for use in practicing the above-described pile-forming method, wherein perforations are provided in the sleeve or cylindrical portion of the boot to permit fill material flow between the zone surrounded by the sleeve portion of the boot and the region immediately outwardly of the external sleeve surface.

Yet another object of the present invention is the provision of a novel design for the driving tip member for use in forming piles by the above-descrived method with a driving mandrel, wherein economies in material and cost of the driving member are achieved by use of a generally circular driving plate having vertically extending locating elements, such as vertically extending rods secured to the plate, or U-shaped bar members assembled through apertures in the plate, or other locator formations adapted to enter the hollow bore portion of the hollow driving mandrel and releasably locate and center the plate-like driving tip member in proper relation to the driving mandrel.

Other objects, advantages and capabilities of the present invention will become apparent from the following detailed description, taken in conjunction with the accompanying drawings illustrating preferred embodiments of the invention.

BRIEF DESCRIPTION OF THE FIGURES

FIGS. 4 and 4A are a vertical section view and a top plan view respectively of another driving boot construction embodying the present invention, wherein an inner cylindrical pipe section enters the bore of the mandrel;

DETAILED DESCRIPTION OF PREFERRED EMBODIMENTS

Figure 1:
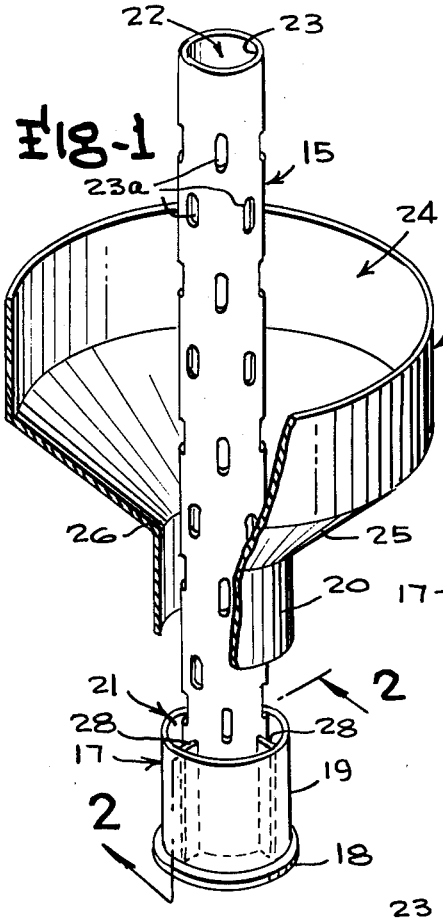
FIG. 1 is a fragmentary perspective view, partially in section, of a caseless concrete pile forming mandrel and an associated fill hopper, showing coupled to the bottom of the mandrel a driving boot constructed in accordance with one embodiment of the present invention.
Figure 2:
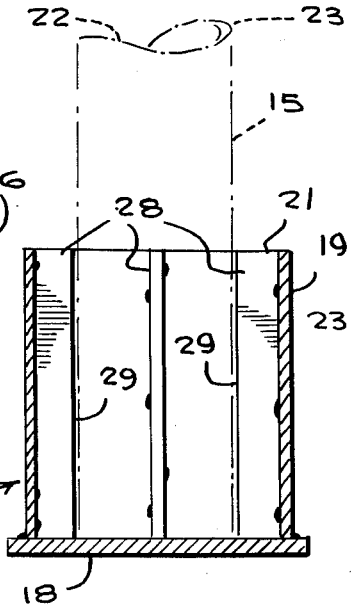
FIG. 2 is a vertical section view of the driving boot of FIG. 1, taken along the line 2—2 of FIG. 1.
Figure 3:
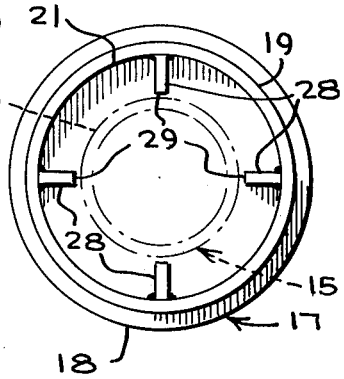
FIG. 3 is a top plan view of the driving boot illustrated in FIG. 2.

Referring to the drawings, wherein like reference characters designate corresponding parts throughout the several figures, the present invention concerns various forms of driving tips or foot members for use in forming caseless cast-in-place concrete piles by driving a hole-forming assembly into the ground to form a pile-forming cavity or hole, and concurrently filling the pile-forming cavity or hole with concrete in flowable condition which then sets in the cavity to form the cast-in-place pile. The driving tips of the present invention are designed to be employed, preferably, with a mechanism for forming pile-forming holes or cavities comprising a vertically elongated driving mandrel 15 extending through a fill hopper 16, with a driving foot or tip member, indicated generally by the reference character 17, releasably assembled onto the lower end of the mandrel 15. In the particular embodiment illustrated in FIGS. 1, 2 and 3, the driving tip or foot 17 is in the form of a boot member, having a bottom plate of leading end plate 18 of flat circular configuration, and an upwardly extending hollow cylindrical sleeve or pipe portion 19 forming an upwardly opening cylindrical cavity or socket to releasably receive in telescoping relation therein the lower end portion of the driving mandrel 15. In the illustrated embodiment of FIGS. 1–3, the bottom or leading end plate 18 is of slightly larger diameter than the outer diameter of the upper sleeve portion 19, although it will be understood that these two diameters may be the same, if desired, and the inner diameter of the sleeve portion 19 is also of somewhat larger diameter than the diameter or maximum transverse dimension of the mandrel 15. In the preferred embodiment of the invention, the maximum diameter of the bottom plate 18 exceeds the maximum diameter or outer diameter of the sleeve portion 19 by approximately two inches, with the outer diameter of the sleeve portion 19 sized to telescopically fit within a downwardly projecting cyclindrical bottom sealing skirt portion 20 of the filler hopper 16, to be later described, and the maximum diameter of the bottom plate 18 being slightly greater than the outer diameter of this skirt portion 20. It will be appreciated that the bottom surface of the driving tip or boot member 17 need not be a flat planiform surface, as illustrated in FIGS. 1–3, but can be a downwardly converging cone, or can assume some other desired configurations.

The upwardly opening hollow cavity or socket 21 defined by the sleeve portion 19 and bottom plate 18 of the boot 17 is sized somewhat larger than the outer diameter of the lower end portion of the driving mandrel 15 to releasably telescopically receive the lower end portion of the driving mandrel 15 therein. In the illustrated embodiment, the driving mandrel 15 serves as an elongated pusher member to drive the boot member 17 into the ground, and the illustrated embodiment is in the form of an axially elongated hollow cylindrical pipe section or tubular mandrel having an axial hollow bore or center opening 22 surrounded by a cylindrical outer wall 23 which may be about one inch thick for a driving mandrel of 8 or 10 inches outer diameter. In the illustrated embodiment, the mandrel 15 is provided with a plurality of openings or apertures **23*a*, which may be circular or oval slotlike openings, disposed at spaced locations in the cylindrical pipe wall 23 to facilitate passage of fill material such as flowable concrete between the space within the mandrel bore 22 and the zone just outwardly of the outer mandrel wall 23. Alternatively, the pusher or drive mandrel may be of other cross-sectional configurations, such as a rectangular tubular configuration with right angular or rounded corners, a cross-shaped cross-section, and H-shaped cross-section, or other desired cross-sectional configurations to provide appropriate rigidity. The cross-sectional configuration of the drive mandrel 15 is chosen, however, so that the total cross-sectional area of the material forming the mandrel wall or the body of the mandrel is much less than the cross-sectional area of the pile-forming hole or cavity to be formed in the earth during driving of the driving foot member 17, so that the concrete or other fill material to form the pile can readily flow by gravity into this space within the cavity not occupied by the material of the mandrel itself. The upper end of the driving mandrel 15 is conventionally shaped to provide for releasable connection of the driving mandrel to the driving head components of a conventional pile-driving rig to permit application of impact driving forces from the pile-driving rig to the upper end of the driving mandrel during forming of the pile-forming cavity in the soil. The mandrel is designed to be withdrawn from the pileforming cavity after it has been formed to the desired depth and filled with the concrete or other fill material, leaving the driving tip or foot 17** at the bottom of the cavity.

In order to effect gravity feeding of the concrete or other fill material into the pile-forming cavity in the soil during the driving of the driving boot or foot member, in the practice of the pile-forming method for which the driving tips of the present invention are designed, the fill hopper 16 is provided at grade level where the pile is to be formed, and may be of the configuration of my copending U.S. patent application filed concurrently herewith, or may be of the configuration disclosed in earlier U.S. patents of Jerry A. Steding, U.S. Pat. No. 3,851,484 and 3,851,485. Such fill hoppers have downwardly and inwardly inclined sidewalls over at least the lowermost half of the fill hopper forming downwardly and inwardly convergent sloping walls circumscribing an upwardly opening receptacle portion and extending downwardly to a bottom discharge opening at the bottom of the receptacle portion having a diameter approximately the same as the outer diameter of the sleeve portion 19 of the driving boot 17 of FIGS. 1–3. If the fill hopper is of the designs disclosed in my copending application filed concurrently herewith, the fill hopper may comprise an upper receptacle portion indicated at 24 in FIG. 1 having inwardly and downwardly inclined lower wall portions 25 extending in a truncated conical or frusto-conical path to a circular bottom opening 26 which is slightly larger than the outer diameter of the mandrel 15. In this embodiment of the fill hopper 16, the hopper is additionally provided with a downwardly extending cylindrical bottom sealing skirt portion, indicated at 20, having a wall thickness corresponding substantially to that of the receptacle portion 24 and having an inner diameter corresponding to the inner diameter of the bottom discharge opening 26. The inner diameter of the skirt portion 20 preferably closely conforms to the outer diameter of the sleeve portion 19 of the driving boot to telescopically receive the latter therein, while the outer diameter of the bottom plate portion 18 of the driving boot is just slightly larger than the outer diameter of the sealing skirt portion 20 so that when the driving boot drives into the soil and forms the cavity adjacent the soil surface, the cylindrical sleeve portion 20 advances downwardly into the cavity under the weight of the mandrel until the inclined wall portions 25 of the hopper are stopped from further downward movement by engaging the surface of the soil.

In many instances, it is difficult to provide driving boots in which the diameter of the sleeve portion is so correlated to the outer diameter of the mandrel or the maximum transverse diametric dimension of the mandrel that the lower end of the mandrel tightly fits within the cavity defined by the sleeve portion of the boot and is automatically centered on the boot. In many cases, the inner diameter of the sleeve portion of the boot may be several inches greater than the outer diameter of the tubular mandrel or the maximum transverse dimension of other shaped mandrels, creating a significant problem of centering the boot on the mandrel. To achieve the proper centering of the boot on the mandrel in such cases, the mandrel is preferably provided with some kind of centering guide structure within the cavity 21 defined by the sleeve portion 19 of the boot providing guide surfaces located in a circular path concentric with the boot center axis and corresponding in diameter to the outer diameter of the mandrel to engage the sides of the mandrel at its lower end portion and center and boot. For example, in the case where a tubular cylindrical mandrel as illustrated in FIG. 1 is being used, the centering structure may take the form of three or four radial guide plates 28, for example four guide plates located in two mutually perpendicular diametric planes of the sleeve portion 19, welded to the inner surface of the cylindrical sleeve 19 and extending the height of the sleeve portion. These guide plates 28 extend radially inwardly from the inner surface of the sleeve 19 a distance equal to one-half the distance between the outer diameter of the mandrel and the inner diameter of the sleeve to provide guide edges or bearing surfaces 29 in confronting relation to the exterior surface of the sleeve portion 19 of the driving boot to bear against and locate the sleeve 19 at a position properly centering the boot.

Figure 4:
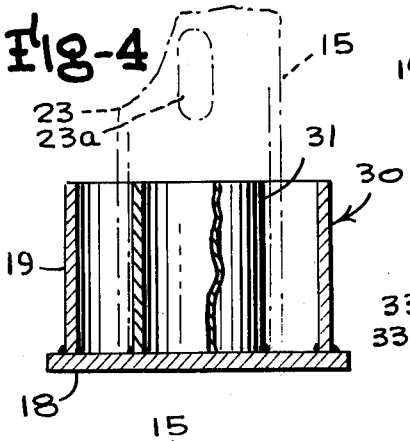

In another form of boot for achieving similar centering of the boot relative to the mandrel 15, the boot may be provided with an inner centering ring or pipe section, similar to the inner pipe section 31 of FIG. 4, located concentric with the center axis of the cylindrical sleeve portion 19 of the boot member but having an outer diameter smaller than the inner diameter of the cylindrical sleeve portion 19 and having an inner diameter corresponding substantially to the outside diameter of the tubular mandrel or the maximum transverse diametric dimension of the mandrel, so that the bottom end of the mandrel closely fits within the smaller diameter cavity formed by the inner ring or pipe section to properly center the boot. Another variation having a centering formation designed to fit inside the boot is illustrated in FIGS. 4 and 4*a*, where the boot is indicated generally by the reference character 30 and comprises a circular bottom plate 18 and a cylindrical sleeve portion 19 like the corresponding elements of the driving boot member 17 of FIG. 1. However, an inner smaller diameter cylindrical centering formation 31 is welded or otherwise secured to the top surface of the bottom plate 18, formed for example, of a cylindrical pipe section 31 or a solid cylindrical block formation, and has an outer diameter substantially equal to the inner diameter of the mandrel 15 to telescopically fit within the bore 22 of the mandrel 15 at the lower end of the mandrel and thereby properly center the driving boot 30.

Figure 5:
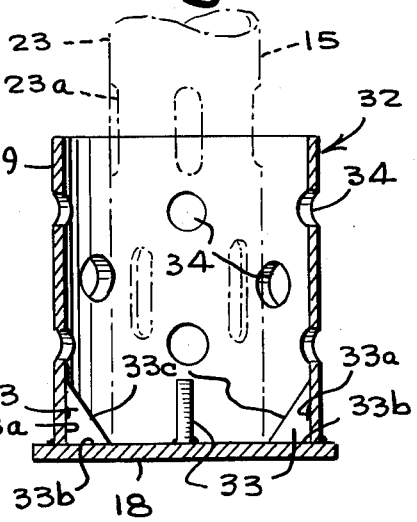
FIGS. 5 and 6 are a vertical section view and a top plan view of another form of driving boot embodying the present invention, having inclined guide plates therein to engage the lower end of the mandrel.
Figure 6:
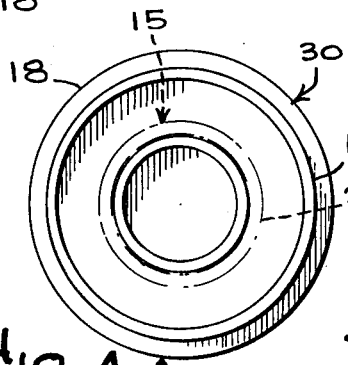
Figure 6:
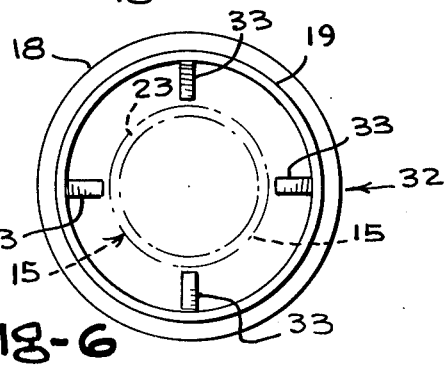

Yet another variation of the driving boot is indicated by the reference character 32 in FIGS. 5 and 6 having the boot centering feature incorporated in another form. In the boot 32 of FIG. 5, the bottom plate 18 and cylindrical sleeve 19 are formed in the same way as the corresponding elements of the embodiments of FIGS. 1 and 4, with the inner diameter of the cylindrical sleeve portion 19 of the boot being several inches larger than the outer diameter of the tubular mandrel 15. In this embodiment, a plurality of right triangular guide plates or web formations 33 are provided, located for example at four circumferentially spaced locations lying in a path of mutually perpendicular diametric vertical planes of the boot, with the vertical straight edge 33*a* of each guide plate welded to the inner surface of the cylindrical sleeve portion 19 and the horizontal edge 33*b* disposed perpendicular to the edge 33*a* and welded to the upper face of the bottom plate 18. The side of the right triangular plates opposite the right angle, indicated by reference character 33c, forms the hypotenuse of the right triangle and presents a downwardly and inwardly inclining guide edge or guide surface joining the upper surface of the bottom plate 18 along a circular concentric path substantially equal to the diameter of the mandrel 15. Therefore, as the mandrel 15 is lowered into the driving boot 32, the lower edge of the mandrel 15 if it is not precisely centered with the driving boot as the mandrel is lowered into the boot, engages one or more of the inclined guide edges 33*c* formed by the four guide plates or web formations 33 which then guide the lower edge of the mandrel downwardly and inwardly to properly centered relation when it abuts the top surface of the bottom plate 18.

For convenience of assembly, or if further reinforcing and strengthening is needed in the lower portion of the driving boot 32, the vertical edges 33*a* of the right triangular guide plates 33 may be welded to an inner reinforcing pipe section having an axial height corresponding to or only slightly greater than the height of the edges 33*a* and having an outer diameter closely corresponding to the inner diameter of the cylindrical sleeve portion 19 of the boot and this assembly of the inner reinforcing pipe section and four triangular guide plates 33 may then be telescopically interfitted in the lower portion of the cylindrical sleeve portion 19 of the boot 32 and welded in position against the bottom plate 18 and the adjacent inner surface of the cylindrical sleeve portion 19.

The form of driving boot shown in FIGS. 5 and 6 also provides a plurality of holes, indicated by the reference character 34, in the cylindrical sleeve portion 19 of the boot, to permit passage of the flowable concrete or fill material from the space within the bore 22 of the mandrel 15 and/or the space immediately outwardly surrounding the exterior surface of the mandrel 15 through the sleeve portion 19 of the driving boot to the zone immediately outwardly of the exterior surface of the sleeve portion 19 in the region lying just above the peripheral portion of the bottom plate 18 projecting outwardly beyond the sleeve portion 19. Provision of these flowable fill material passages 34 may be desirable, for example, to permit the flowable concrete in the region between the sleeve portion 19 and mandrel 15 to pass outwardly through the openings 34 and line the walls of the cavity being formed by the boot in the zone immediately above the outwardly projecting peripheral portion of the bottom plate 18 to reduce friction against the surfaces of the sleeve portion 19 and retard pinching in or expansion of the cavity walls into the cavity just formed by the bottom plate 18.

It will be understood that this provision of perforations such as the holes 34 in the cylindrical sleeve portion 19 of the driving boot may be incorporated in each of the other forms of driving boot disclosed herein and may also be incorporated in the smaller diameter pipe section located concentrically within the cavity 21 formed by the outer cylindrical sleeve portion 19 adapted to closely accommodate the exterior wall portion of the mandrel at the bottom or interfit in the bore 22 of the mandrel 15.

Figure 7:
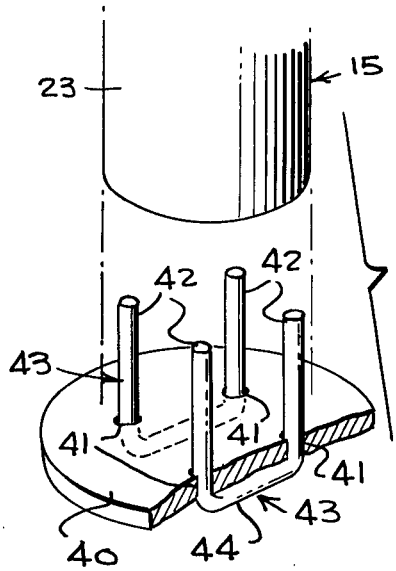
FIG. 7 is an exploded perspective view of another form of driving tip having a perforated plate and U-shaped locating rod members extending through apertures in the plate to engage the interior walls of the mandrel bore for locating the driving tip.

Considerable economies in the cost of materials and labor in producing satisfactory driving tip members for use in practicing the method of forming cast-in-place caseless concrete piles previously described can be achieved by eliminating the cylindrical sleeve portion 19 of the boot members previously described and simply using a generally circular or disc-shaped metal plate of appropriate thickness and rigidity at the bottom of the driving mandrel together with some means for suitably centering the circular plate relative to the mandrel and maintaining it in such properly centered position. One form of plate-type driving tip is illustrated in FIG. 7, wherein the circular metallic plate 40 is formed of corresponding diameter and thickness to the bottom plate 18 of the previously described boot-type driving tips 17. That is to say, the diameter of the circular driving plate 40 may be enough greater than the diameter of the mandrel 15 to equal or slightly exceed the diameter of the lower discharge opening 26 in the receptacle portion of the fill hopper or may equal or slightly exceed the outer diameter of the self-sealing cylindrical skirt portion 20 of the fill hopper 16 to form a generally cylindrical cavity in the soil or ground to permit the cylindrical skirt portion 20 to advance under the weight of the fill hopper into the ground cavity in self-sealing relation. To maintain the driving plate properly located and centered relative to the lower end of the mandrel 15, the solid circular dirving plate 40 is provided with four openings 41 arranged along a pair of parallel vertical planes perpendicular to the surface of the circular driving plate 40 and located symmetrically on opposite sides of and parallel to a diametrical axis of the driving plate. The openings are paired, as illustrated, to receive a pair of upwardly projecting parallel leg portions 42 of U-shaped rod members 43, such as standard reinforcing rods of appropriate thickness, having a lower cross piece or bridge portion 44 whose length corresponds to the space between the paired set of openings 41 through which the associated leg portions 42 are to extend. The location and spacing of the openings 41 and the leg portions 42 of the U-shaped rod members are such as to locate the four rod members immediately inwardly against the inner surface of the mandrel tube wall 23 bounding the bore 22 of the mandrel so that these rod leg portions 42 interfit within the mandrel bore 22 in light contact with or immediately inwardly of the inner surfaces of the mandrel wall 23. Preferably the holes 41 and rod leg portions 42 are spaced at the four corners of a square pattern with the diagonally opposite rod legs 42 spaced apart such that the maximum dimension spanned by them substantially equals the inner diameter of the mandrel 15, which is the diameter of the bore 22.

This construction provides a very economical and advantageous construction for a satisfactory driving tip for the mandrel 15, in that the circular plate 40 may be simply formed to resemble a button by providing four holes for the two pairs of legs of the two U-shaped rod members 43 and the U-shaped rod members 43 may be conveniently cut and bent from conventional reinforcing rod stock and interfitted in the openings 41 sized to correspond to the diameter of the reinforcing rod stock to frictionally hold the rod members 43 in position. The driving tip formed of the plate 40 and rod members 43 can be then placed on the ground at the pile site, and the mandrel lowered downwardly onto the plate to receive the leg portions 42 of the rod members in the bore of the mandrel and the mandrel and driving plate 40 may then be driven to the appropriate depth for the pile to be formed. The flowable concrete or other fill material may be supplied to the cavity concurrently during formation of the cavity or at the conclusion of its formation and the mandrel withdrawn, leaving the leg portions 43 of reinforcing rod stock embedded in the concrete column to hold the driving tip 40 and rod members 43 assembled to the concrete column when the concrete sets.

It will be appreciated that the U-shaped rod members 43 may be loosely assembled with the driving plate 40 with the leg portions 42 extending through the openings 41, or may be more securely fastened to the plate 40 by welding the U-shaped rod members to the plate 40 at any of several locations such as locations along the cross piece 44 where it contacts or is closely adjacent to the lower surface of the plate 40 or the welds can be located in the region where the leg portions 42 exit from the openings 41 at either the upper or lower surfaces of the driving plate.

Figure 8:
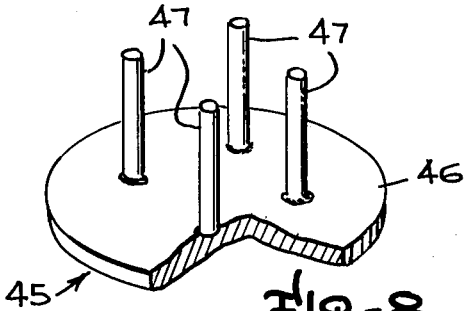
FIG. 8 is a perspective view of another driving tip construction having a plate and locating rods welded thereto to extend into the mandrel bore.

Alternatively, the plate-type driving tip may be of the construction illustrated in FIG. 8, wherein the driving tip, indicated generally by the reference character 45, comprises a circular driving plate like the driving plate of FIG. 7, but indicated here by the reference character 46, which does not have openings 41 therein but simply has four straight short sections of reinforcing rods or similar rod stock forming leg members 47 similar to the leg portions 42 of FIG. 7, but welded at their lower ends to the circular plate 46. The rod members or legs 47 of the circular plate type driving tip 45 of FIG. 8 are located in the same manner as the leg portions 42 of the FIG. 7 embodiment so that the diagonally opposite pairs of legs 47 span the inner diameter of the mandrel 15 and interfit into the bore 22 in light contact with or immediately inwardly of the inner surfaces of the mandrel wall 23 bounding the bore 22. It will be appreciated that in both the FIG. 7 and FIG. 8 forms, the legs 42 or 47 need not be located at the corners of a square, but can be located at the corners of a rectangle, with the pair of legs 42 at the ends or short sides of the rectangle spaced closer together than the spacing between the legs measured along the long side of the rectangle, so long as the diagonal pairs of legs span or approximately span the inner diameter of the mandrel.

Figure 9:
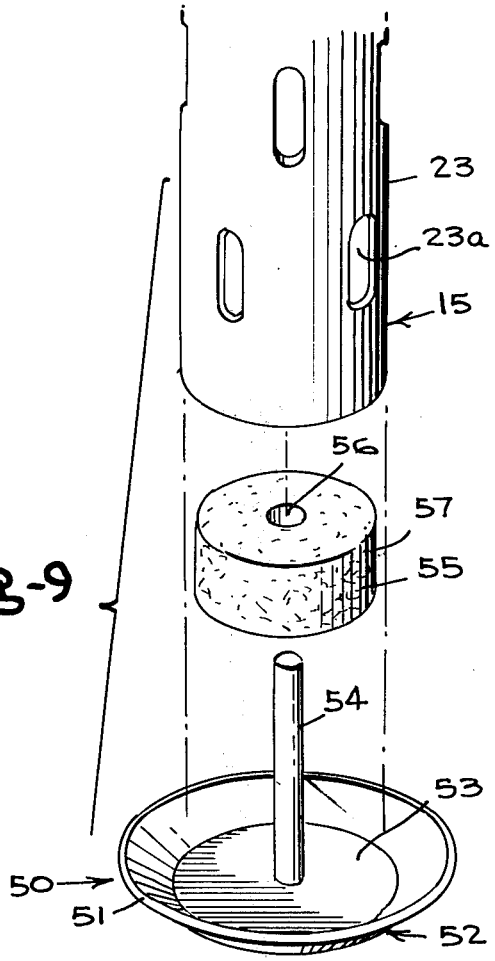
FIGS. 9 and 10 are an exploded perspective and a vertical section view, respectively, of another form of driving tip having a concrete spacer removably assembled thereon to extend into the mandrel bore.
Figure 10:
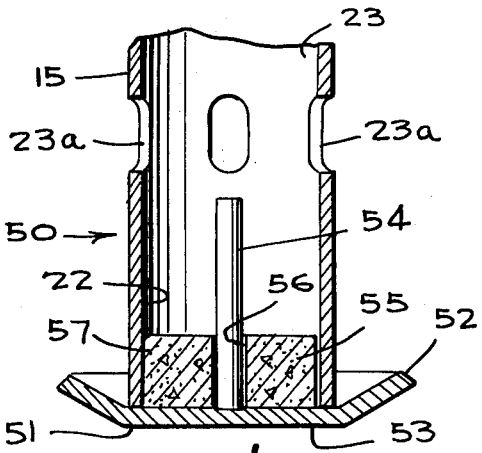

Yet another form of plate-like driving tip is illustrated in FIGS. 9 and 10 and indicated by the reference character 50. This tip comprises a lower plate member 51 serving a function similar to the circular plates 40 or 46 of the embodiments of FIGS. 7 or 8, but shown in FIGS. 9 and 10 as a somewhat dished or deformed circular plate 51 having a frusto-conical rim portion 52 and a flat lower center circular portion 53. In this illustrated embodiment, a centering rod 54, for example, formed of reinforcing rod stock, is welded to the center of the circular plate 51, and a cast annular centering spacer 55 of concrete or other material is provided, having a center opening 56 to fit over and receive the centering rod 54 and having a circular outer periphery 57 whose diameter corresponds substantially to the inner diameter of the mandrel 15 to interfit into the bore 22 at the lower end of the mandrel and properly center the circular driving plate 51 relative to the mandrel. When the plate-type driving tip 50 with the concrete centering spacer 55 thereon is driven to the proper depth for the pile forming cavity and the concrete or other fill material has been flowed into the cavity to fill the same and the mandrel withdrawn, the concrete used to fill the cavity will join the concrete spacer 55 and the centering rod portion 54 projecting above the spacer 55 to securely couple the driving plate 51 to the concrete column.

Figure 11:
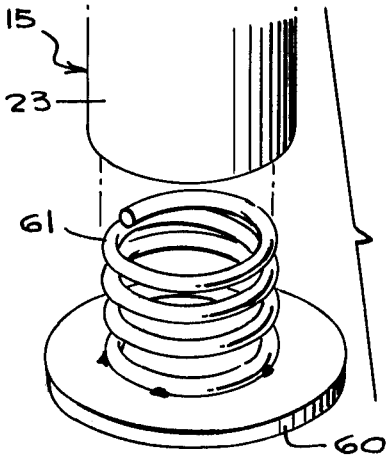
FIG. 11 is a perspective view of yet another form of driving tip which may be used in forming cast-in-place concrete piles by the previously discussed method.

Other forms of centering devices or circular driving plates may also be employed, to be used with the hollow driving mandrel previously described. For example, as illustrated in FIG. 11, a solid circular driving plate 60 may be employed having the same size and configuration as the circular driving plates of FIGS. 7 and 8, and have a coil spring section 61 welded thereto, wherein the diameter of the coil spring convolutions corresponds to or is only slightly smaller than the inner diameter of the hollow tubular mandrel 15 to interfit into the bore 22 of the mandrel and properly center the driving plate 60 during the driving of the pile-forming cavity, and to freely withdraw from the mandrel cavity 22 when the mandrel is raised at the end of the pile cavity forming operation to become embedded in the concrete or other fill material and securely join the plate 60 to the concrete column. Likewise, where the driving plate 60 is of considerably larger diameter than the outer diameter of the mandrel, a coil spring similar to the coil spring 61 but having an inner diameter for its convolutions substantially equalling the outer diameter of the mandrel may be employed to be received in outwardly surrounding relation about the lower end of the mandrel 15 and appropriately center the driving plate 60. The coil springs for either the plate-type driving tip wherein the coil fits within the mandrel bore or fits in outwardly surrounding relation about the lower end of the mandrel may have convolutions of progressively reducing diameter progressing from the end of the coil joined to the plate 60 to the upper free end of the coil. In such cases, the lowermost coil convolution should approximate the inner diameter of the mandrel if the coil is to fit within the mandrel, or the inner diameter of the uppermost coil convolution should slightly exceed the outer diameter of the mandrel if the coil is to fit in outwardly surrounding relation about the mandrel.

What is claimed is:

1. A driving tip member for use with a vertically elongated hollow driving mandrel to be driven into the earth by pile driving equipment and thereby produce a vertically elongated pile-forming hole for forming a cast-in-place caseless pile of fill material or the like which is introduced in flowable condition into the hole and sets upon curing, and wherein the driving mandrel is an elongated tubular cylinder having an annular cylindrical tube wall surrounding an axial bore therethrough and terminating in a lower end portion of predetermined outer diameter, the diameter of the mandrel being sufficiently smaller than the diameter of the pile-forming hole to be formed to provide both an outer annular surrounding space about the mandrel and an inner cylindrical space within the mandrel into which gravity flow of the fill material downwardly about and within the mandrel will occur, the driving tip member comprising a rigid lower leading end plate of substantially planiform configuration and circular cross-section of a diameter corresponding to the desired pile diameter and larger than the outer diameter of the mandrel lower end portion to be releasably assembled therewith, and a plurality of laterally spaced mandrel interfitting centering guide members carried by the end plate and rising perpendicularly from the end plate to fit into the mandrel bore in concentric relation over a predetermined axial extent and thereby center and releasably assemble the end plate with the mandrel solely by interfitting the guide members into the mandrel bore, the centering guide members being formed of a plurality of more than two like straight parallel rod members of small diameter assembled to and carried by the end plate, said rod members extending upwardly from said end plate at circumferentially spaced locations along a circular path having a diameter slightly smaller than the inner diameter of the mandrel and concentric with the center axis of the circular end plate providing radially outwardly facing, vertically elongated abutment surface portions to interfit into the mandrel bore and inwardly confront in closely adjacent relation the inwardly facing surface of said tube wall.

2. A driving tip member as defined in claim 1, wherein said centering guide members are formed of reinforcing rod stock for reinforced concrete or the like.

3. A driving tip member as defined in claim 1, wherein said centering guide members are formed of four like straight parallel rod members of small cross-section assembled to and carried by the end plate, said rod members extending upwardly from said end plate at circumferentially spaced locations along said circular path at four corners of a rectangle whose diagonal aproximates the inner diameter of the mandrel providing said abutment surface portions to interfit into the mandrel bore and inwardly confront in closely adjacent relation the inwardly facing surface of said tube wall.

4. A driving tip member as defined in claim 1, wherein said centering guide members are formed of four like straight parallel rod members of small cross-section formed of reinforcing rod stock for reinforced concrete or the like assembled to and carried by the end plate, said rod members extending upwardly from said end plate at circumferentially spaced locations along said circular path at four corners of a rectangle whose diagonal approximates the inner diameter of the mandrel providing said abutment surface portions to interfit into the mandrel bore and inwardly confront in closely adjacent relation the inwardly facing surface of said tube wall.

5. A driving tip member as defined in claim 1, wherein said centering guide members are formed of four like straight parallel rod members of small cross-section welded to and carried by the end plate, said rod members extending upwardly from said end plate at circumferentially spaced locations along said circular path at four corners of a rectangle whose diagonal approximates the inner diameter of the mandrel providing said abutment surface portions to interfit into the mandrel bore, and inwardly confront in closely adjacent relation the inwardly facing surface of said tube wall.

6. A driving tip member as defined in claim 1, wherein said centering guide members are formed of four like straight parallel rod members of small cross-section assembled to and carried by the end plate, said rod members extending upwardly from said end plate at circumferentially spaced locations along said circular path at four corners of a rectangle whose diagonal approximates the inner diameter of the mandrel providing said abutment surface portions to interfit into the mandrel bore and inwardly confront in closely adjacent relation the inwardly facing surface of said tube wall thereof, said end plate having apertures therethrough as the corner locations for said rods and the rod members being formed by the two legs of each of two U-shaped rod sections extending through the apertures in said end plate with the two rod sections paralleling each other on opposite sides of a diameter of the end plate.

7. A driving tip member as defined in claim 1, wherein said centering guide members are formed of four like straight parallel rod members of small cross-section formed of reinforcing rod stock for reinforced concrete or the like assembled to and carried by the end plate, said rod members extending upwardly from said end plate at circumferentially spaced locations along said circular path at four corners of a rectangle whose diagonal approximates the inner diameter of the mandrel providing said abutment surface portions to interfit into the mandrel bore and inwardly confront in closely adjacent relation the inwardly facing surface of said tube wall thereof, said end plate having apertures therethrough at the corner locations for said rods and the rod members being formed by the two legs of each of two U-shaped rod sections extending through the apertures in said end plate with the two rod sections paralleling each other an opposite sides of a diameter of the end plate.

* * * * *